United States Patent [19]

Kawasaki

[11] Patent Number: 4,602,137

[45] Date of Patent: Jul. 22, 1986

[54] PULL-PUSH SWITCH

[75] Inventor: Kenzo Kawasaki, Miyagi, Japan

[73] Assignee: Alps Electric Co., Ltd., Japan

[21] Appl. No.: 376,104

[22] Filed: May 7, 1982

[30] Foreign Application Priority Data

May 7, 1981 [JP] Japan ..... 56-65165[U]

[51] Int. Cl.[4] ..... H01H 5/18

[52] U.S. Cl. ..... 200/76; 200/293

[58] Field of Search ..... 200/76–78, 200/250, 290, 303, 293, 243, 67 A, 67 C; 29/622, 225–230

[56] References Cited

U.S. PATENT DOCUMENTS

| | | | |
|---|---|---|---|
| 1,861,046 | 5/1932 | Bower | 200/76 |
| 2,384,412 | 9/1945 | Woods | 200/76 |
| 2,967,218 | 1/1961 | Dorjee | 200/76 |
| 3,402,374 | 9/1968 | Gaines et al. | 200/76 X |
| 3,598,945 | 8/1971 | Matsui | 200/76 |
| 3,641,292 | 2/1972 | Tanaka | 200/76 |
| 3,731,016 | 5/1973 | Nadaguchi | 200/11 R |
| 3,840,838 | 10/1974 | Ja et al. | 338/198 |
| 3,939,318 | 2/1976 | Brown et al. | 200/159 R |
| 4,086,455 | 4/1978 | Takahashi | 200/76 |

*Primary Examiner*—Stephen Marcus
*Assistant Examiner*—Ernest G. Cusick
*Attorney, Agent, or Firm*—Guy W. Shoup

[57] ABSTRACT

In a pull-push switch having an insulating case, an operating shaft, movable contacts, stationary contacts, and inverting springs, the movable and stationary contacts being engaged or disengaged through the inverting springs by pushing or pulling the operating shaft; the improvement comprising the fact that the stationary contacts are disposed on the inner surface of one side plate of the insulating case, that the inverting springs are directly extended between the movable contacts and the operating shaft, and that tapered portions for guiding the installation of the inverting springs are disposed on the inner surface of the side plate. The improved pull-push switch is small in size, and is efficiently assembled.

1 Claim, 6 Drawing Figures

PULL-PUSH SWITCH

BACKGROUND OF THE INVENTION

The present invention relates to a pull-push switch for use as a power source switch or the like. More particularly, it relates to a pull-push switch in which a movable contact and a stationary contact are engaged and disengaged through an inverting spring by the pull-push operation of an operating shaft.

A known type of pull-push switch is shown in FIGS. 1 and 2.

In these figures, numeral 1 designates an insulating case constructed by upper and lower housing parts 1*a* and 1*b* each formed in the shape of an open box. The open portions of the housing parts are made to face one another to form a central open area for parts of the switch, and a metal frame 2 is provided for holding the housing parts together.

A lower wall portion of the case 1 is provided with a hole 1*c*, and a bearing 3 is supported adjacent the hole 1*c* by an adapter plate 4. An operating shaft 5 is disposed in the bearing 3 in a manner so that it may be freely pushed and pulled for axial movement. An engaging groove 5*a* for engaging inverting springs, to be described below, is provided in the peripheral surface of the fore end of the operating shaft 5. Shown at numeral 6 is an E-ring for holding the operating shaft 5 within the bearing.

Guide groove 1*d* extending parallel to the axis of the operating shaft 5 are respectively provided in the inner portions of opposing side walls of the insulating case 1, as shown clearly in FIG. 2. An actuator 7 formed of an insulating material into a generally U-shape is held in an inverted condition by the guide grooves 1*d* and can slide vertically within the insulating case 1. In the top part of the actuator 7 as viewed in FIG. 1, a pair of movable contacts 9, 9 are disposed through respective spring members 8, 8. In correspondence with the movable contacts 9, 9, a pair of stationary contacts 11, 11 are fixedly disposed on the upper wall portion of the insulating case 1. The stationary contacts 11, 11 are connected to terminals 11*a*, 11*a* respectively. Both of the movable contacts 9, 9 are electrically connected together by a path not shown, through the actuator 7. Thus, switch contacts are constructed of the movable contacts 9, 9 and the stationary contacts 11, 11.

The lower portions of the depending leg portions of the actuator 7 are provided with spring engaging holes 7*a*, 7*a*. A pair of inverting springs 12, 12 are formed generally as shown in FIG. 2 and have their crossed end portions within respective spring engaging holes, and are compressed between the spring engaging holes 7*a*, 7*a* and the engaging groove 5*a* of the operating shaft 5. As shown in FIG. 2, the inverting spring 12 is so formed that a linear spring member is bent into the shape of an isosceles triangle of small height. Both end parts 12*a*, 12*a* in a position corresponding to the vertex are inserted into the spring engaging hole 7*a* in an intersecting fashion. An engaging portion 12*b* corresponding to the base of the triangle is fitted in and engaged with the engaging groove 5*a*.

When the operating shaft 5 is pulled for axial movement away from the case 1, the end parts 12*a* of the inverting springs 12 move upward in FIG. 1, and the movable contacts 9, 9 come into contact with the stationary contacts 11, 11 respectively, so that the switch is set into the ON state (the state shown in FIG. 1). On the other hand, when the operating shaft 5 is pushed inwardly of the case 1, the inverting springs 12 are inverted in the direction opposite to the above, and the movable contacts 9, 9 move away from the stationary contacts 11, 11, so that the switch turns into the OFF state.

In accordance with the recent miniaturization of various electronic devices, the pull-push switch as above described has been required to be smaller in the outside dimensions.

In such prior-art pull-push switch, however, the insulating actuator 7 is disposed in the insulating case 1 in the manner to be movable in the same direction as the operating direction of the operating shaft 5, and the movable contacts 9, 9 are disposed in the actuator 7. Accordingly, the pull-push switch has the problem that the thickness of the insulating case 1 in the direction of the operating shaft 5 increases, so the miniaturization cannot be achieved satisfactorily.

The inverting spring 12 extended across the actuator 7 and the operating shaft 5 has both the end parts 12*a*, 12*a* inserted through the engaging hole 7*a*, and has the side of the engaging portion 12*b* fitted in and engaged with the engaging groove 5*a* of the operating shaft 5 in the compressed state. This leads to the problems that the assembling of the switch and the attendant fitting and engagement of the various paths are very troublesome, that a comparatively long time is taken for assembly, and that a high cost of the product is incurred.

SUMMARY OF THE INVENTION

The present invention has been made in view of such problems of the prior art, and has for its object to solve these problems.

According to the present invention, an insulating actuator is not used and the inverting spring is instead connected to movable contacts. In order to ease assembly to the switch, means are provided for guiding installation of the inverting springs onto the fore end part of the operating shaft of the switch.

PREFERRED EMBODIMENT OF THE INVENTION

Hereunder will be described an embodiment of FIGS. 3 to 5 in which the present invention is applied to a pull-push switch provided with a volume control.

Figure 1:
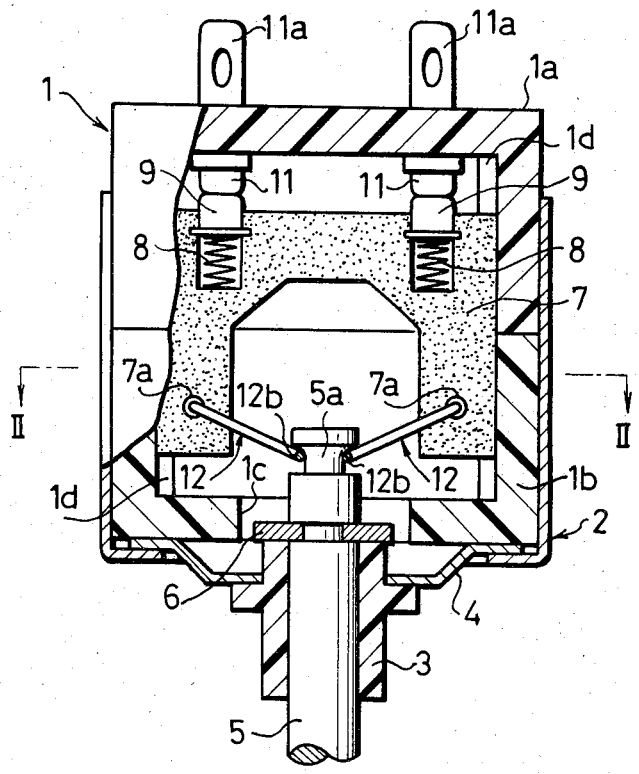
Fig.1 PRIOR ART
FIG. 1 is a side view, partly in section, showing a prior-art pull-push switch.
Figure 2:
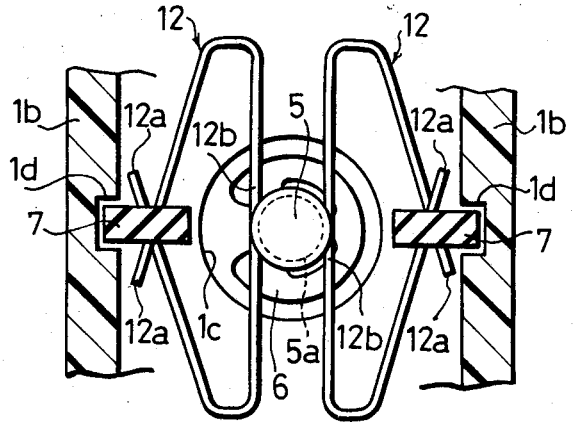
Fig.2 PRIOR ART
FIG. 2 is a sectional view taken along line II—II in FIG. 1, with some parts omitted.

In the figures, constituents identical or equivalent to the members or parts shown in FIGS. 1 and 2 are assigned the same reference numerals. They will not be repeatedly explained.

First, the construction will be described. In the present invention, the lower housing part 1*b* is formed generally in the shape of an open box, but it is assembled in the opposite sense to that of the corresponding part in FIG. 1. That is, the part 1*b'* of the housing part 1*b* that may be considered the bottom plate of the box-like structure is held in opposing contact with the upper housing part 1*a* to form a cross-wall portion. The interior of the insulating case 1 is divided into two by the bottom plate 1*b'* of the lower housing part 1*b*. A case portion defined by the bottom plate 1*b'* and the upper housing part 1*a* is used as a switch mechanism portion A. A case portion defined by the lower housing part 1*b* and an insulating substrate 13 disposed at the opening of the former is used as a volume control mechanism portion B.

The operating shaft 5 is inserted through a hole 13*a* provided in the insulating substrate 13. It penetrates through the volume control mechanism portion B, and its fore end part protrudes into the switch mechanism portion A from the bottom plate 1*b'* forming the lower side of the switch mechanism portion A. The operating shaft 5 is free to move axially and also may be rotated, and is held by the E-ring 6 abutting a step portion 1*g* recessed in the bottom plate 1*b'*.

Figure 4:
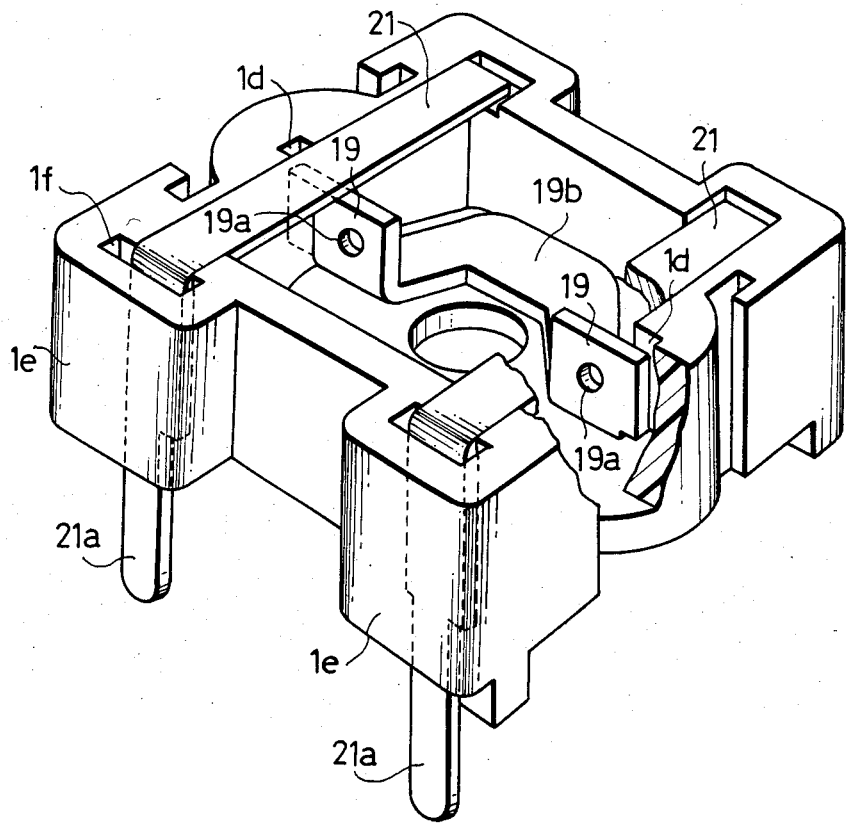
FIG. 4 is a perspective view as seen along line IV—IV in FIG. 3.
Figure 5:
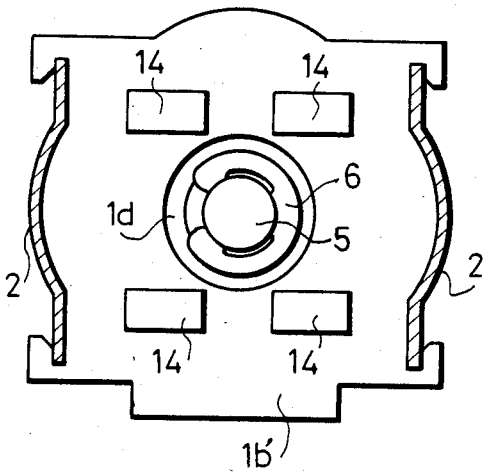
FIG. 5 is a plan view as seen along line V—V in FIG. 3.

On the other hand, in guide grooves 1*d*, 1*d* provided in the opposing inner wall parts of the upper housing part on the side of the switch mechanism portion A, flat movable contacts 19, 19 as also shown in FIG. 4 are disposed in a manner to be movable in the direction parallel to the axis of the operating shaft 5. By way of example, the movable contacts 19, 19 are fabricated by bending a single plate body. Both the movable contacts 19, 19 are connected by an arm portion 19*b*.

In correspondence with the movable contacts 19, 19, flat stationary contacts 21, 21 are fixedly disposed on respective side parts of the bottom plate 1*b'*. Each stationary contact 21 has a terminal 21*a* bent and formed on one end side thereof. The terminals 21*a*, 21*a* extend outwardly from the case 1 through rectangular holes 1*f*, 1*f* provided in side extension portions 1*e*, 1*e* of the upper housing part 1*a*.

The movable contacts 19, 19 are provided with spring engaging holes 19*a*, 19*a*, for receiving the end portions of the inverting springs 12, 12 and the inverting springs 12, 12 are held between these spring engaging holes 19*a*, 19*a* and the engaging groove 5*a* of the operating shaft 5.

On that surface of the bottom plate 1*b'* which lies on the side of the portion A, tapered portions 14 for guiding the installation of the inverting springs 12 with the engaging groove 5*a* extend upwardly from the plate 1*b'*. As shown in FIG. 5, four of these tapered portions 14 are provided. The tapered portions 14 are formed by with slanting surfaces whose heights gradually decrease from the side on which the movable contact 19 is disposed, toward the side in which the operating shaft 5 is disposed, with reference to the surface on which they are disposed, i.e. the surface of the bottom plate 1*b'*.

Numeral 15 in the volume control mechanism portion B indicates a slider receiver, numeral 16 a slider, and symbol 16*a* a contactor piece. The slider receiver 15 turns with the turning operation of the operating shaft 5. A resistor layer and an appropriate conductor layer, not shown, are disposed on the insulating substrate 13 along the sliding path of the contactor piece 16*a*.

Figure 6:
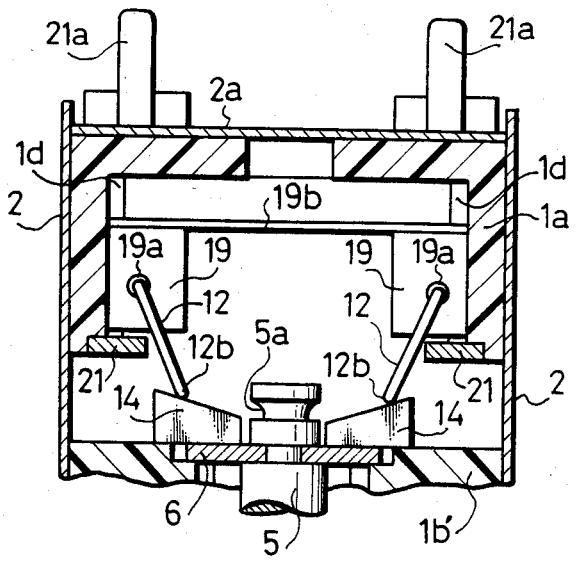
FIG. 6 is a side sectional view showing an assembling process.

Next, the installation of the inverting springs 12, etc. and the operation will be described by referring also to FIG. 6.

The volume control mechanism portion B including the operating shaft 5 is assembled on the lower housing part 1*b*, and the resultant structure is mounted on the metal frame 2 in advance.

Subsequently, the movable contacts 19, 19 and the stationary contacts 21, 21 are installed on the upper housing part 1*a*. Further, the inverting springs 12, 12 are mounted to the movable contacts 19 by inserting their end parts through the spring engaging holes 19*a* of the movable contacts 19. When, under this mounted state, the upper housing part 1*a* is brought into the position shown in FIG. 6, the inverting springs 12, 12 are pivotally supported in the engaging holes 19*a* of the movable contacts. Next, the first case constituent 1*a* held in the aforecited position has its open side inserted into the metal frame 2 and is pushed downwardly. At this time, the inverting springs 12, 12 are in the state in which their engaging portions 12*b*, 12*b* abut on the tapered portions 14, 14, as shown in FIG. 6. When the upper housing part 1*a* is further depressed, the engaging portions 12*b*, 12*b* are guided by the tapered portions 14, 14 and move toward the operating shaft 5. When the upper housing part 1*a* has been pushed in to the position where it abuts on the lower housing part 1*b*, the engaging portions 12*b*, 12*b* are automatically fitted in and engaged with the engaging groove 5*a* of the operating shaft 5. Thereafter, the end parts of the metal frame 2 are bent and caulked onto an adapter plate 2*a* situated on the rear surface portion of the upper housing part 1*a*. Then, the assemblage of the push-pull switch with the volume control as shown in FIG. 3 is completed.

Figure 3:
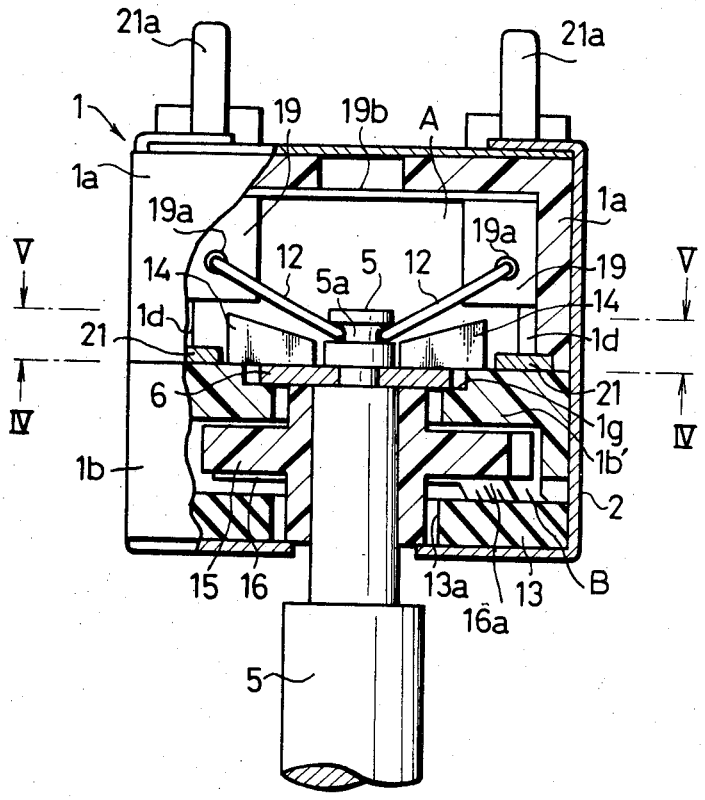
FIG. 3 is a side view, partly in section, showing an embodiment of a pull-push switch according to the present invention.

In case of an adjusting operation, when the operating shaft 5 is pulled, axially outwards of the case 1. the end parts 12*a* of the inverting springs 12 move upward as viewed in FIG. 3, and the movable contacts 19, 19 move away from the stationary contacts 21, 21, so that the switch turns into the OFF state. On the other hand, when the operating shaft 5 is pushed inwardly of the case 1, the inverting springs 12 are inverted in the direction opposite to the above, and the movable contacts 19, 19 come into contact with the stationary contacts 21, 21, so that the switch turns into the ON state.

When the operating shaft 5 is turned in, for example, the state in which the switch is ON, the volume control mechanism portion A is operated.

As described above in detail, according to the present invention, the stationary contacts are fixedly disposed on the inner surface parts of one side plate on the side on which the operating shaft is disposed in the insulating case, the inverting springs are directly held between the movable contacts and the operating shaft, and tapered portions for guiding the installation of the inverting springs are disposed on the inner surface parts of the side plate. Therefore, the invention brings forth the effects that the insulating actuator can be dispensed with and that the outside dimensions including the thickness can be reduced. Accordingly, even when the volume control is equipped, the outside dimensions of the whole pull-push switch can be made approximately equal to those of the prior-art pull-push switch. Since the inverting springs can be automatically placed between the movable contacts and the operating shaft during the assemblage between the first and second case constituents, the invention brings forth the effects that the assembling job efficiency is remarkably improved, that the assembling time is shortened and that the cost can be curtailed.

I claim:

1. A pull-push switch comprising an insulating case having opposing side wall portions and a cross-wall portion extending therebetween, an operation shaft extending slidably through a central portion of said cross-wall portion and having a peripheral groove formed on a fore end portion thereof, movable contacts respectively held slidably in guide grooves formed in said side wall portions, said guide grooves extending parallel to the axis of said operation shaft to enable said movable contacts to move in directions parallel to the axis of said operation shaft, stationary contacts held in said case in a position along one end portion of the path of movement of said movable contacts, inverting springs held between said movable contacts and said peripheral groove of the fore end portion of said operation shaft, and means including tapered portions upstanding from said cross-wall portion and having the upper surface thereof decreasing gradually towards said operation shaft for guiding installation of said inverting springs about said peripheral groove of the fore end portion of said operating shaft.

* * * * *